United States Patent [19]

Bender et al.

[11] Patent Number: 4,644,863

[45] Date of Patent: Feb. 24, 1987

[54] ELECTRIC DETONATOR

[75] Inventors: Richard Bender, Lauf/Bayern; Hellmut Bendler, Nuremberg; Horst Penner, Fürth/Bayern; Reinhold Sander, Seukendorf/Bayern, all of Fed. Rep. of Germany

[73] Assignee: Dynamit Nobel Aktiengesellschaft, Troisdorf, Fed. Rep. of Germany

[21] Appl. No.: 669,798

[22] Filed: Nov. 9, 1984

[30] Foreign Application Priority Data

Nov. 9, 1983 [DE] Fed. Rep. of Germany ..... 3340461

[51] Int. Cl.[4] ..... F42E 19/12

[52] U.S. Cl. ..... 102/202.5; 102/202.3

[58] Field of Search ..... 102/202.5, 202.3, 202.4, 102/202.7, 202.8, 202.9, 202.14, 472

[56] References Cited

U.S. PATENT DOCUMENTS

| | | | |
|---|---|---|---|
| 2,921,520 | 1/1960 | Stonestrom | 102/202.8 |
| 3,286,631 | 11/1966 | Gawlick et al. | 102/202.8 |
| 3,763,782 | 10/1973 | Bendler et al. | 102/202.8 |
| 3,867,885 | 2/1975 | Gawlick et al. | 102/202.9 |
| 4,206,707 | 6/1980 | Shores | 102/472 |
| 4,409,898 | 10/1983 | Blix et al. | 102/202.5 |

FOREIGN PATENT DOCUMENTS

| | | | |
|---|---|---|---|
| 286154 | 11/1970 | Austria . | |
| 960787 | 3/1957 | European Pat. Off. . | |
| 0029671 | 6/1981 | European Pat. Off. . | |
| 1036138 | 8/1958 | Fed. Rep. of Germany | 102/202.5 |
| 3035932 | 5/1982 | Fed. Rep. of Germany . | |
| 1600106 | 7/1970 | France . | |
| 2506927 | 12/1982 | France | 102/202.5 |

*Primary Examiner*—Charles T. Jordan

*Attorney, Agent, or Firm*—Antonelli, Terry & Wands

[57] ABSTRACT

An electric detonator has a casing and a pole piece electrically insulated with respect to the casing by means of an insulating cup, as well as with an ignition resistor electrically conductively connected to the casing and to the pole piece. In order to avoid undesirable charges on the insulating cup, which could be the cause of misfirings, the insulating cup is associated with an electrically conductive coating in contact with the casing and with the pole piece.

11 Claims, 3 Drawing Figures

ELECTRIC DETONATOR

The invention relates to an electric detonator having a metal casing with a pole piece electrically insulated from the casing by an insulating cup and an ignition resistor electrically connected to the casing and the pole piece and having means for providing a controlled electrical shunt as a high-ohmic resistance between the pole piece and the casing.

Electric detonators with a casing and with a pole piece electrically insulated with respect to the casing by means of an insulating cup have been known, for example, from DOS No. 3,035,932. These detonators furthermore comprise a so-called ignition resistor which connects the pole piece with the housing in an electrically conductive fashion. The ignition resistor can be an ignition gap, but preferably it is designed as an ignition bridge. The resistance of the ignition gap or bridge is generally between 1 and 100Ω.

It is possible in such detonators, as has been found surprisingly, for minimum displacements to occur between the pole piece and the casting on account of internal stresses after these detonators have been forced into the primer cap of the cartridge cases of electrically to be detonated ammunition, whereby undesirable electric charges can be produced on the insulating cup which can be so high that they lead to discharges and, thus, to improper misfirings.

The invention is based on the object of providing a detonator wherein undesired charging of the insulating cup and ensuing misfirings do not occur.

This object has been attained by the means for providing the controlled electrical shunt between the pole piece and the casing. For this purpose, the insulating cup can be provided, for example, on its outer and inner surfaces with, respectively, one separate, electrically conductive coating, which coatings are not in contact with each other. The coatings can be applied in accordance with the procedure described hereinbelow, for example, in the form of a synthetic resin solution with electrically conductive particles suspended therein. The surface conductivity ranges preferably between about 0.5 kΩ and 1MΩ, measured between two contact points placed at a spacing of 1 cm on the respective coating surface.

However, instead of two separate coatings, the provision can also be made to establish a controlled electric shunt—with reference to the ignition resistor—between the casing and the pole piece. This high-ohmic electrically conductive connection between the pole piece and the casing can be effected, for example, by filling the gap existing between these components with a varnish exhibiting a high-ohmic electric resistance due to admixture of electrically conductive materials, such as, for example, graphite, carbon black, or metallic powder.

In an advantageous further development of the detonator, the conductive connection between the pole piece and the casing is established by the formation of a high-ohmic, electrically conductive coating on the entire surface of the insulating cup. This solution has the advantage that the high-ohmic electric resistance between the pole piece and the casing can be set and controlled in a simple way. The solution has the further advantage that the high-ohmic, electrically conductive connection is formed on the insulating cup which cup has a high mechanical strength; whereas the electrically conductive molded components of a synthetic resin possess a relatively low mechanical strength.

According to another aspect of the invention, the material of the insulating cup is provided with a bore and optically additional perforations and is treated with a solution of a synthetic resin wherein electrically conductive materials are suspended. The bore serves for contacting the pole piece from the outside. By arranging the additional perforations, the objective is achieved that the synthetic resin solution coats the material of the insulating cup from both sides, and an especially satisfactory high-ohmic, electrically conductive connection is established between the two sides of cup. In an especially advantageous embodiment of the invention, the material of the insulating cup is shaped into the actual cup only after treatment with the synthetic resin solution, having originally, for example, a strip shape.

According to this invention, the preferred proportion of the electrically conductive material in the synthetic resin solution is 20–100% by weight, based on the synthetic resin proportion. The resistance of the high-ohmic, electrically conductive connection between the pole piece and the casing is preferably 0.2 kilohm to 1 megohm. Preferred synthetic resins employed for the synthetic resin solutions of this invention are polystyrene, acrylic resins, polyesters, or polyvinyl butyral. Preferred solvents for the synthetic resin solution are acetic acid alkyl esters or alcohols of up to 4 carbon atoms in the alkyl residue. However, other solvents can also be utilized, such as acetone, for example. Carbon black or graphite is preferably used as the electrically conductive material. Other electrically conductive materials, such as metallic powders, for example, can also be used in the high-ohmic, electrically conductive connection of this invention.

The invention will be described in greater detail hereinafter with reference to embodiments shown in the drawings which illustrate the following:

Figure 1:
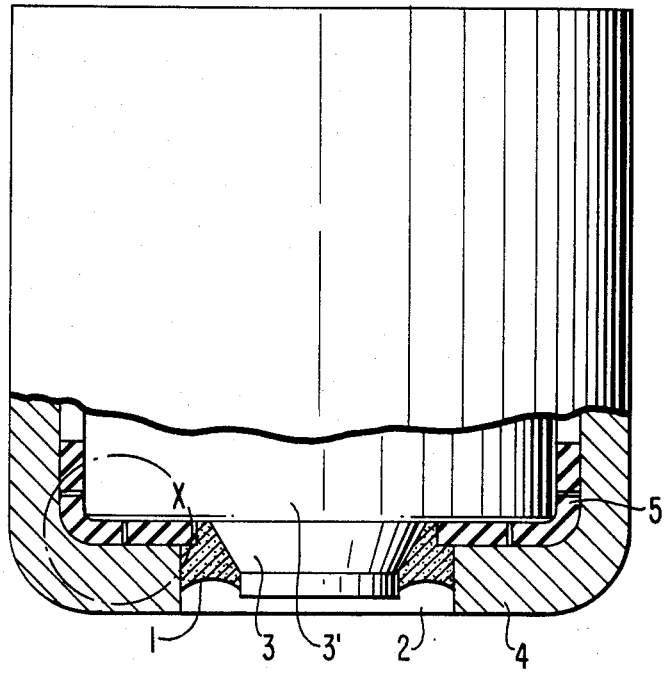
FIG. 1 shows a partial axial section of an electric detonator.

FIG. 1 illustrates a portion of an electric detonator in a sectional view. A pole piece 3, 3' made preferably of brass, but also, for example, of steel or an aluminum alloy, is contained in a casing 4 which consists preferably of a noncorrosive metal or a corresponding metal alloy, such as, for example, brass, copper, or aluminum; the pole piece being electrically insulated with respect to the casing 4 by means of an insulating cup 5. The insulating cup consists preferably of vulcanized fiber. However, it can also consist of another electrically insulating material with high mechanical strength, such as, for example, phenol-formaldehyde resin laminates, epoxy glass fiber fabric, rigid PVC, and the like. The detonator has a gap 2 between the pole piece 3, 3' and the casing 4 and insulating cup 5, respectively. This gap is filled up with the varnish ring 1 which provides a high-ohmic, electrically conductive connection between the pole piece 3, 3' and the casing 4 and which contains an admixture of resin and electrically conductive materials, such as, for example, graphite, carbon black, or metallic powder. In the preferred embodiments of the invention wherein the insulating cup is provided with two separate coatings or with an allaround coating or resin containing the electrically conductive materials, no varnish ring 1 is contained in the gap 2.

Figure 2:
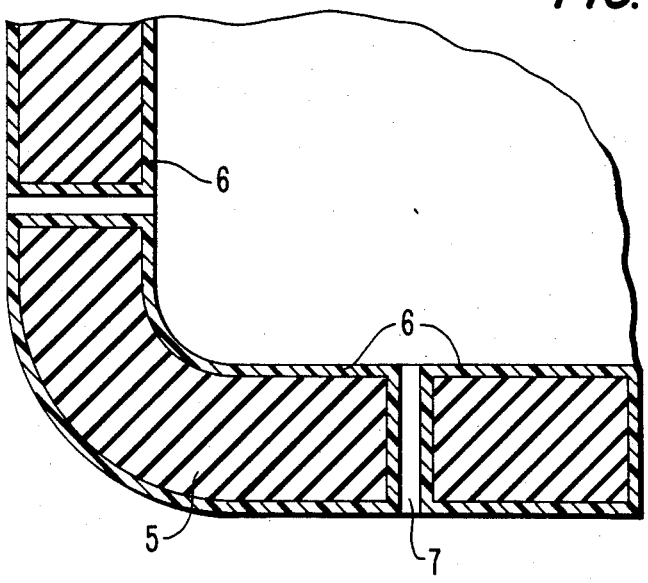
FIG. 2 shows a partial axial section of an insulating cup according to the circle X in FIG. 1 on an enlarged scale.

FIG. 2 illustrates one preferred embodiment of the invention. The insulating cup 5 exhibits the additional perforations 7. The surface of the insulating cup and the wall surfaces formed by the perforations are covered by a synthetic resin 6 containing electrically conductive materials. The thus-treated insulating cups are primarily manufactured according to two different methods:

(1) The material from which the insulating cup is produced, present, for example, the strip shape, is first provided with the performations 7. Subsequently, the strip is varnished on both sides, dipped into a solution or imprinted; in this step, the strip is in each case coated according to this invention with the solution of synthetic resin 6 wherein electrically conductive materials are suspended. After evaporation of the solvent, the material for the insulating cup 5 is coated with the synthetic resin containing the conductive materials in such a way that a continuous high-ohmic, electrically conductive connection is ensured between both sides of the material. After providing the bores for contacting the pole piece 3, 3', the material of the cup is punched out in correspondence with the size of the insulating cup and shaped into the insulating cup.

(2) The procedure of (1) is observed, in principle, but the material is provided, prior to coating with the synthetic resin solution, merely with bores for the contacting of the pole piece 3, 3'.

It is, of course, also possible to vary the sequence of steps with respect to formation of the bores and of the perforations. The essential aspect resides in that the above-mentioned high-ohmic, electrically conductive connection between both sides of the material and, thus, of the insulating cup 5 is ensured by application of the synthetic resin solution.

It is possible in this embodiment of the invention to determine the resistance of the high-ohmic electric shunt formed on the insulating cup, prior to inserting into the casing an ignition bridge carrier, for example, which forms a low-ohmic resistance, by measurement between the housing 4 and the pole piece 3, 3', or between the housing 4 and a metallic test element—in this case before assembly of the pole piece—and, if necessary, to sort out any insulating cups not exhibiting the required resistance.

Figure 3:
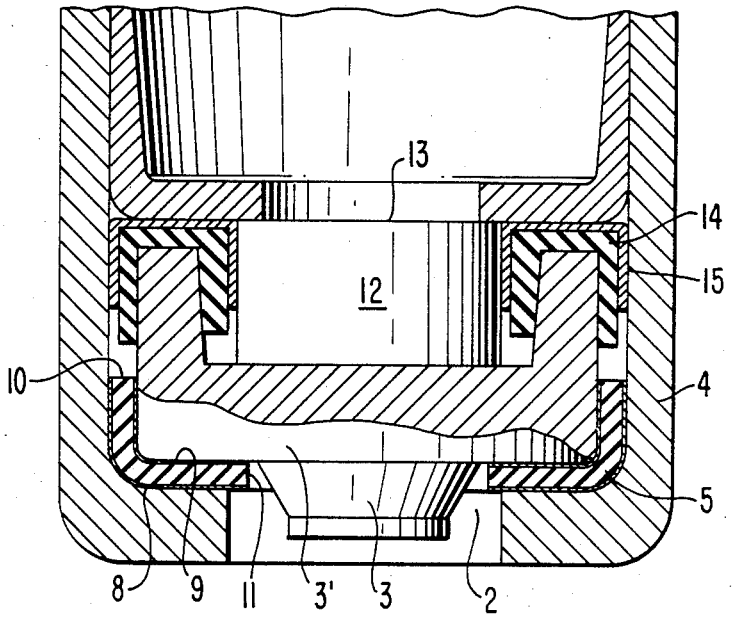
FIG. 3 is a partial axial section of another embodiment of the electric detonator.

FIG. 3 shows another preferred embodiment wherein the insulating cup 5 has no additional perforations and is provided only on its outside 8 and its inside 9 with an electricaly conducting coating, but not on the two annular surfaces 10 and 11. The coatings are illustrated in exaggerated thickness for reasons of clarity of the drawing. Also, with the use of this feature, it is possible to avoid beforehand any undesired charges on the insulating cup 5 and thus any unintentional triggering of the detonator.

FIG. 3 shows furthermore the electrically non-conductive support 12, on the topside 13 of which the ignition resistor is formed in a conventional way—see, for example, U.S. Pat. No. 3,763,782. The electrically conductive contact ring 15 serves for contacting with the casing 4, this contact ring being insulated, in turn, with respect to the upper part of the pole piece 3' by the electrically non-conductive ring 14. This structure is known and is not the subject of the invention.

What is claimed is:

1. An electric detonator with a casing, a pole piece electrically insulated with respect to the casing by means of a non-conductive insulating cup, and an ignition resistor electrically connected to the casing and to the pole piece, characterized in that an electrically conductive coating is provided on the insulating cup, said coating being in contact with the casing and the pole piece to form an electrically conductive connection which is high-ohmic as compared to the ignition resistor between the pole piece and the casing in order to attain a controlled electric shunt in parallel to the ignition resistor.

2. A detonator according to claim 1, characterized in that a solution of a synthetic resin wherein electrically conductive materials are suspended is applied to the material of the insulating cup after provision of a bore for contacting the pole piece from the outside and optionally additional perforations.

3. A detonator according to claim 2, characterized in that the proportion of electrically conductive material in the synthetic resin solution is 20–100% by weight, based on the synthetic resin proportion.

4. A detonator according to claim 2, characterized in that the resistance of the high-ohmic, electrically conductive connection between the pole piece and the casing is 0.2 kilohm to 1 megohm.

5. A detonator according to claim 3, characterized in that the resistance of the high-ohmic, electrically conductive connection between the pole piece and the casing is 0.2 kilohm to 1 megohm.

6. A detonator according to claim 2 characterized in that the synthetic resin comprises polystyrene, acrylic resin, polyester or polyvinyl butyral.

7. A detonator according to claim 2, characterized in that the solution contains as a solvent, acetic acid alkyl esters or alcohols having up to 4 carbon atoms in the alkyl group.

8. A detonator according to claim 2, characterized in that the electrically conductive material is carbon black or graphite.

9. A detonator according to claim 1, characterized in that said coating comprises a synthetic resin having electrically conductive materials suspended therein, said coating being applied to at least two sides of the insulating cup and the insulating cup having a bore for allowing contact with the pole piece.

10. A detonator according to claim 1, characterized in that the coating comprises a synthetic resin having electrically conductive materials suspended therein and the coating is applied to all sides of the insulating cup.

11. A detonator according to claim 1, characterized in that the coating comprises a synthetic resin containing electrically conductive materials and the insulating cup has perforations through which the coating extends from a side of the insulating cup adjacent to the pole piece to a side of the insulating cup adjacent to the casing.

* * * * *